United States Patent [19]

Dömland et al.

[11] Patent Number: 4,479,479

[45] Date of Patent: Oct. 30, 1984

[54] ELECTRONICALLY CONTROLLED IGNITION SYSTEM AND USE OF THIS IGNITION SYSTEM

[75] Inventors: Christoph Dömland, Wolfsburg; Willy Minner, Schwaigern, both of Fed. Rep. of Germany

[73] Assignees: Telefunken Electronic GmbH, Heilbronn; Volkswagenwerk AG, Wolfsburg, both of Fed. Rep. of Germany

[21] Appl. No.: 357,671

[22] Filed: Mar. 12, 1982

[30] Foreign Application Priority Data

Mar. 26, 1981 [DE] Fed. Rep. of Germany ..... 3111856

[51] Int. Cl.[3] ..... F02P 11/00

[52] U.S. Cl. ..... 123/630; 123/609; 123/644

[58] Field of Search ..... 123/609, 630, 644, 645

[56] References Cited

U.S. PATENT DOCUMENTS

| | | | |
|---|---|---|---|
| 3,937,193 | 2/1976 | Kim | 123/644 |
| 4,099,495 | 7/1978 | Kiencke et al. | 123/480 |
| 4,228,779 | 10/1980 | Wetzel | 123/652 |
| 4,239,024 | 12/1980 | Leichle | 123/416 |
| 4,356,808 | 11/1982 | Bodig et al. | 123/644 |
| 4,368,717 | 1/1983 | Roberts et al. | 123/644 |
| 4,392,474 | 7/1983 | Minner | 123/644 |
| 4,429,235 | 1/1984 | Minner | 307/356 |

FOREIGN PATENT DOCUMENTS

| | | | |
|---|---|---|---|
| 2047586 | 3/1972 | Fed. Rep. of Germany . | |
| 2539113 | 3/1977 | Fed. Rep. of Germany . | |
| 2747819 | 4/1979 | Fed. Rep. of Germany . | |
| 2900480 | 7/1980 | Fed. Rep. of Germany . | |
| 37241 | 4/1978 | Japan | 123/630 |

*Primary Examiner*—Parshotam S. Lall
*Assistant Examiner*—W. R. Wolfe
*Attorney, Agent, or Firm*—Spencer & Frank

[57] ABSTRACT

An electronically controlled ignition system is provided in which the point in time at which the primary current flowing through the primary winding of the ignition coil starts, is controlled as a function of speed so that the said primary current only reaches the value required for ignition just before the ignition time and in which immediately before the ignition time, it is ascertained whether the primary current has reached the value required for ignition, wherein if there is no primary current or insufficient primary current to prevent ignition during periodic fluctuations in speed, the electronic control arrangement is switched off for a fixed period and the time at which the primary current is used is derived directly from the control signal of the ignition pulse generator and in which, once the switch off period has come to an end, continuous and automatic electronic control is reinstituted.

14 Claims, 25 Drawing Figures

A = U IN
T
HIGH
LOW
t

Ipr
Ipr max

Ipr
Ipr max

Uc1
UREF
Uc1
UREF(const)

T
T/10
HIGH
LOW te
Uc1
UREF
Uc1
UREF (VAR)

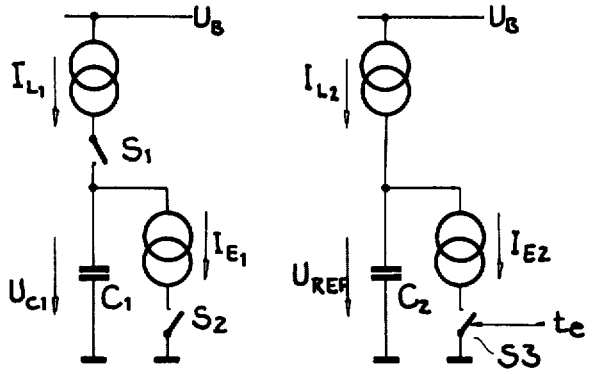
Fig.1g Fig.1h
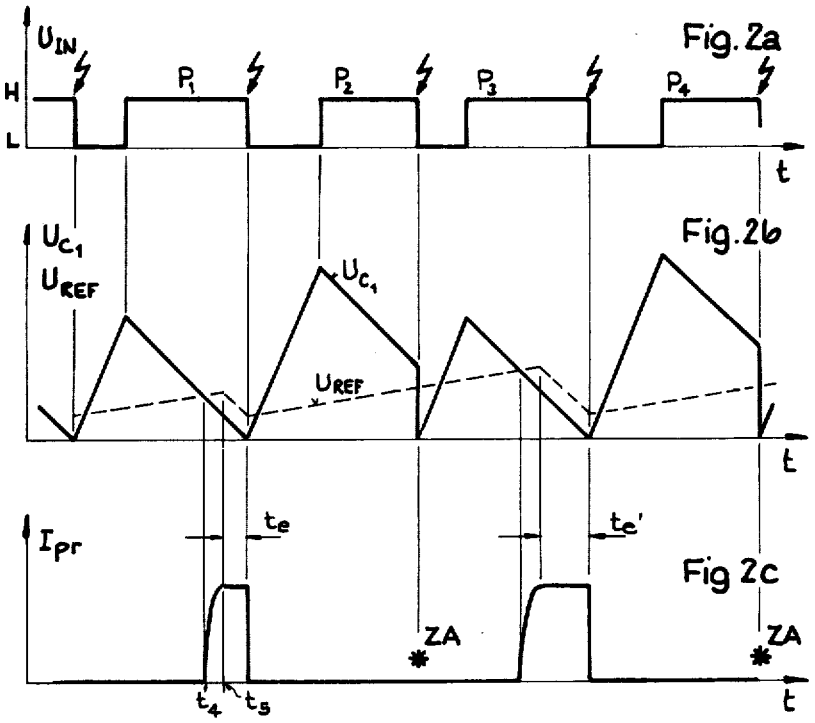

U_IN
H
L
P1
P2
P3
P4 t
U TRIGGER
tx t
U*REF
U*REF
Uc1
UREF
Uc1 t
te
te'
te"
Ipr
Ipr max
ZA* t
te
te'
te"
H
L t
Uc3
Uc3
Uv
Uv t
UMF t

U_IN
P1
P2
P3
P4
P5
t
T

T_MF
U_C1
U_REF
U_REF
U_C1
B1
B2
B3 t
t_v1
t_v2
t_v3
I_pr t
t_e1
t_e2
t_e3
t_e4
t_e5
H
L
t

ELECTRONICALLY CONTROLLED IGNITION SYSTEM AND USE OF THIS IGNITION SYSTEM

BACKGROUND OF THE INVENTION

The invention relates to an electronically controlled ignition system in which the time at which the primary current flowing through the primary winding of the ignition coil starts is controlled as a function of speed so that the said primary current only reaches the value required for ignition just before the ignition time. An electronically controlled ignition system of this type is the subject of an earlier German patent application No. P30 34 176.5 for example.

Combustion engines exhibit extreme fluctuations in the acceleration of the engine shaft during the start-up phase up to a speed of approximately 1000 RPM. Known electronically regulated ignition systems controlled by the engine shaft are not able to follow these large variations in acceleration quickly enough, so that in some circumstances mis-firing may result. If there is periodic mis-firing then the running of the motor is irregular and normal running of the motor will not be achieved after start-up. This cannot be remedied by changing the control time constant of the electronic ignition system generally, since the control process has to follow variations in acceleration quickly enough at medium and high speeds.

SUMMARY OF THE INVENTION

It is an object of the invention therefore to provide an electronically controlled ignition system in which mis-firing is prevented safely when there are periodic fluctuations in speed.

According to the invention, there is provided an electronically controlled ignition system in which the point in time at which the primary current flowing through the primary winding of the ignition coil begins is controlled so that the said current only reaches the value required for ignition just before the ignition time in which, immediately before the ignition time, it is ascertained whether the primary current has reached the value required for ignition; wherein if there is no primary current or insufficient primary current to prevent mis-firing during periodic fluctuation in speed, the electronic control arrangement is switched off for a fixed period and the point in time at which the primary current begins is derived directly from the control signal of the ignition pulse generator; and in which once said fixed switch off period has come to an end continuous and automatic control is reinstituted.

BRIEF DESCRIPTION OF THE DRAWINGS

The invention will now be described in greater detail, by way of example with reference to the drawings in which:

FIGS. 1*g* and 1*h* show circuit schematics for producing sawtooth type voltage curves shown in the diagrams of FIGS. 1*a* to 1*f*.

FIGS. 2*a* to 2*c* are voltage-time diagrams showing disruptive mis-firing;

DESCRIPTION OF THE PREFERRED EMBODIMENTS

Figure 1:
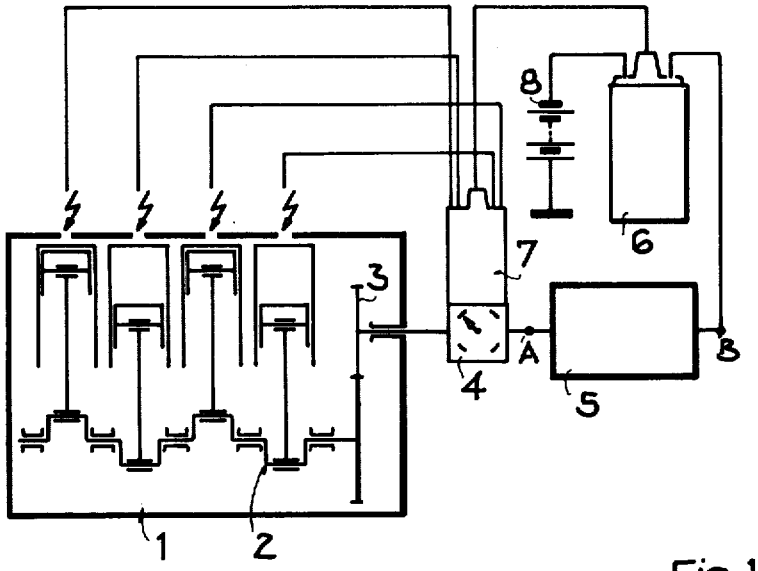
FIG. 1 shows a block circuit diagram of an ignition system in which the present invention can be used.

In a preferred embodiment of the invention, in a system as described at the outset, it is determined whether the primary current $I_{pr}$ has reached the value $I_{prmax}$ required for ignition directly before the ignition time in an electronically controlled ignition system of the type described at the outset. If the primary current is not provided or is not sufficiently high to prevent mis-firing when there are periodic fluctuations in speed (ZA), then the electronic control arrangement is switched off for a fixed period $T_{MF}$ and the time at which the primary current begins is ascertained directly from the control signal $U_{IN}$ of the ignition pulse generator, and by reinstituting the electronically controlled control condition both continuously and automatically once this fixed switch off period $T_{MF}$ has come to an end.

In the case of the present electronically controlled ignition system, a test pulse is derived, preferably from the duration of the primary current at or above the value required for ignition, and this test pulse can be used to vary the voltage applied to a capacitor. This capacitor voltage is compared to a fixed comparison voltage and from this comparison it is possible to find out whether the primary current has reached a sufficiently high value before an ignition time predetermined by the control signal of the ignition pulse generator. If such a high value has not been reached, then a function is triggered which switches off the electronic control for a fixed period. The said capacitor is discharged only by the test pulses and is otherwise charged up. The pulse duration of the test pulses corresponds preferably to the duration of the primary current at or above the value required for ignition. The charge and discharge time constants of the voltage at the said capacitor are selected so that the voltage always falls below the value of the comparison voltage when there is a discharge process caused by a test pulse and always rises above the value of the comparison voltage in the following charging process. A comparator is preferably provided for comparison of the two voltages and is activated briefly for voltage comparison at the ignition time—as predetermined by the control signal of the ignition pulse generator.

In order to activate the comparator, activating pulses are derived from the pulse flanks of the control signal, which initiate ignition, preferably at the beginning of each ignition phase. These activating pulses are obtained, by way of example, by differentiating the control signal, derived from the ignition pulse generator, and subsequently suppressing the pulses arising from the positive flanks of the control signal. The comparator, triggered by the activating pulses, is provided with an output signal only when the capacitor voltage is higher than the comparison voltage when there is an activating pulse present.

When there is an output signal at the comparator, a monostable trigger stage connected after the comparator may be changed over from the stable into the quasi-stable condition, for example, and the electronic control arrangement is switched off by this switching process for a period fixed by the duration of the trigger stage in the quasi-stable condition. This switch off period will last at least for a few periods of the control signal emitted by the ignition pulse generator. In one embodiment the switch off time may be approximately 300 msec to 1.5 sec.

The electronically controlled ignition system which includes switching off the controlled arrangement in accordance with the invention during a limited period is suitable in particular for use within a system in which the time at which the primary current begins is fixed from the point of intersection of the negative flank of a sawtooth voltage derived from the control signal of the ignition pulse generator with a reference voltage.

Referring now to the drawings, in FIG. 1 the engine 1 is indicated by the cylinders and the crank shaft 2. The crank shaft controls an ignition pulse generator 4 through gearing 3, this ignition pulse generator 4 delivering an electronic output signal A or $U_{IN}$ in accordance with FIG. 1*a*. This control signal $U_{IN}$ is passed to the electronically controlled ignition system 5 whose output signal B in turn controls the primary current through the ignition coil 6. The primary current of the ignition coil is supplied by the battery 8 connected thereto. The ignition pulses pass from the secondary circuit of the ignition coil 6 via the distributor 7 to the individual spark plugs of the internal combustion engine 1.

Figures 1A, 1B, 1C, 1D, 1E, 1F:
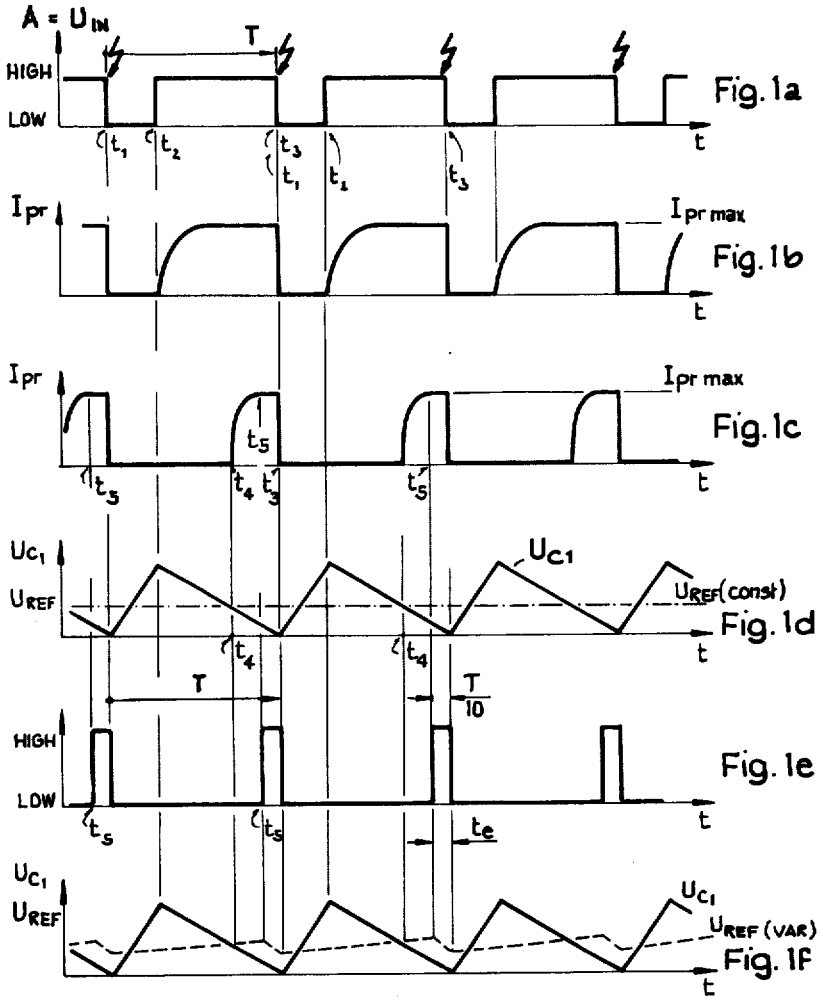
FIGS. 1*a* to 1*f* are voltage-time diagrams showing the mode of operation of the electronically controlled ignition system of FIG. 1.

In the diagram of FIG. 1*a*, the control signal $U_{IN}$ which appears at the output of the ignition pulse generator 4 is shown and the flank which passes from the high level to the low level in each case triggers ignition at the point in time $t_1$. The low condition of the control signal $U_{IN}$ during the time $t_1$–$t_2$ is called the ignition phase. In the high condition of the control signals $U_{IN}$ in the time between $t_2$ and $t_3$, which is also designated the time at which the contacts close, the primary current may flow through the ignition coil. The ratio between the time at which the contacts close and the period T is designated as the closure angle.

In the diagram of FIG. 1*b* the primary current through the ignition coil in a mechanical ignition system is shown. The current is limited to a fixed amplitude value $I_{prmax}$ which is sufficient for ignition. As can be gathered from the diagram, the primary current starts to flow at the point in time $t_2$ and in particular reaches its maximum value long before the ignition time $t_3$ in the lower speed range of the engine.

Electronically controlled ignition systems seek to avoid the losses arising from the long duration of the primary current at its maximum. These losses which are converted to heat in the ignition coil result in an unnecessarily high load on the battery. Electronic ignition systems therefore seek to make the primary current available in a magnitude which is sufficient for ignition, only just before ignition. In the case of electronically controlled ignition systems therefore, the primary current follows a path in accordance with the diagram of FIG. 1*c*. It is apparent from this that the primary current only starts to flow at a point in time $t_4$ after a time delay as compared to a mechanical system and reaches its maximum value $I_{prmax}$ at the point in time $t_5$ which is shortly before the beginning of the ignition phase at the ignition time $t_3$.

How such control of the primary current is achieved is apparent for example from the earlier German patent application No. P30 34 176.5. The mode of operation will be described again with reference to diagrams 1*d* to 1*f* and the general circuit arrangements in accordance with FIGS. 1*g* and 1*h*.

During the low period, of the control signal $U_{IN}$ between $t_1$ and $t_2$ in accordance with FIG. 1*a*, which corresponds to the ignition phase, a capacitor $C_1$ is charged with the current $I_{L1}$ in accordance with FIG. 1*g*, and during the time $t_2$ to $t_3$ in the high phase of the control signal, is discharged with the current $I_{E1}$. As a result, a sawtoothed voltage $U_{C1}$ is applied to the capacitor $C_1$ in accordance with FIG. 1*d*. This voltage $U_{C1}$ is compared to a reference voltage, $U_{REF}$ and the point of intersection of the negative flank of the sawtooth voltages $U_{C1}$ with the reference voltage which is assumed in FIG. 1*d* to be constant, fixes the point in time at which the current in the primary winding is allowed to flow. The voltages compared in accordance with FIG. 1*d* intersect for example at the point in time $t_4$ which is identical to the beginning of flow of the current in the primary winding. It is apparent, for example, from the earlier German patent application No. P30 34 176.5 how the output signal which allows the flow of the primary current can be obtained from the voltage comparison.

The reference voltage $U_{REF}$ should be dependent on speed, in contrast to the view of FIG. 1*d*, so that the rise time of the coil current, which is effectively only dependent on the coil inductance and battery voltage and therefore is independent of speed is compensated. This compensation or balancing out may be achieved with the aid of a sawtooth type reference voltage in accordance with FIG. 1*f*. In accordance with FIG. 1*h* a second capacitor $C_2$ is charged with a constant current $I_{L2}$ and discharged by a second current $I_{E2}$ as the switch $S_3$ is actuated. The current $I_{E2}$ is only switched on during the time when the primary coil current $I_{pr}$ is at its maximum $I_{prmax}$. The switch $S_3$ in FIG. 1*h* therefore has to be controlled with the aid of a pulse which is shown in FIG. 1*e* and is derived from the duration of the primary coil current at its maximum during the time $t_5$–$t_3$. It is apparent for example from the earlier German patent application No. P30 15 939.8 how such a pulse may be obtained.

If the discharge current $I_{E2}$ is selected for example to be eleven times larger than the charge current $I_{L2}$ then the system is controlled automatically so that the duration of the current $I_{pr}$ at the maximum $I_{prmax}$ is approximately 10% of the total period T. The reference voltage $U_{REF}$ in accordance with FIG. 1*f* rises slightly until the current $I_{pr}$ through the primary coil has reached its maximum value $I_{prmax}$ and falls more steeply during the time $t_e$ during which the primary current continues at its maximum. The pulses in FIG. 1*e* (hereinafter referred to as the $t_e$ pulses) which control the discharge process begin at $t_5$ shortly before the ignition time and end at the ignition time $t_3$. The reference voltage $U_{REF}$ therefore has to be lower than the capacitor voltage $U_{C1}$ which reaches its maximum at the point in time $t_2$ at the end of the ignition phase in order for there to be electronic control of the ignition process. It should also be mentioned that with an electronically controlled ignition system means are provided which completely discharge the capacitor $C_1$ at the beginning of an ignition phase at the point in time $t_3$ so that each subsequent charge process starts from the zero volt line. How this is accomplished is also apparent from the earlier German patent application No. P30 34 176.5 which has already been mentioned.

If during the starting phase of the engine, as already mentioned mis-firing occurs at very low speeds, then the output signal $U_{IN}$ follows the path shown in FIG. 2a. It can be seen from the diagram that, during the second period $P_2$, as shown, the ignition phase was extended as compared to the first and third period at the cost of the contact closure time. The same error occurs in the fourth period $P_4$, which is also shown. The capacitor voltage $U_{C1}$ and the reference voltage $U_{REF}$ follow a path in accordance with FIG. 2b in the electronically controlled ignition system. In view of the substantially longer ignition phase of the control signal $U_{IN}$, the voltage $U_{C1}$ rises during the period $P_2$ to a substantially higher value than during the preceding period $P_1$. In the shortened high time which follows the low time of period $P_2$ the voltage $U_{C1}$ can no longer fall below the reference voltage $U_{REF}$ so that, in accordance with FIG. 2c, mis-firing ZA occurs. The reference voltage $U_{REF}$ is not therefore lowered at the end of the second period because the $t_e$ pulse is not present, but rather it rises so that, during the third period $P_3$, the point of intersection between the reference voltage and the voltage $U_{C1}$ is above the intersection point during the first period $P_1$. As a result the primary current begins to flow at an earlier point in time, in accordance with FIG. 2c, so that the duration $t_e'$ of the primary current is greater at its maximum than the time $t_e$ which occurs during the first period $P_1$. During the fourth period $P_4$, which is also shown, mis-firing occurs again because of the extended low time of the control signal and because of the correspondingly reduced high time. The reference voltage is discharged to a greater extent during the third period because of the increased duration $t_e'$ of the primary current at its maximum. In view of these processes the ignition system may attain a oscillating condition in which the engine speed can no longer be affected by an increased supply of fuel so that there is no guarantee that the engine will go to normal running speed after start up.

Figure 3:
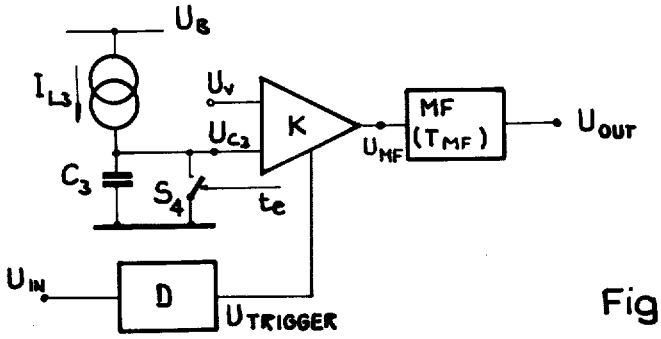
FIG. 3 is a partial block circuit diagram and circuit schematic of a circuit which is used to disconnect the electronic control arrangement for a limited period in accordance with the invention.
Figures 5A, 5B, 5C, 5D, 5E, 5F, 5G:
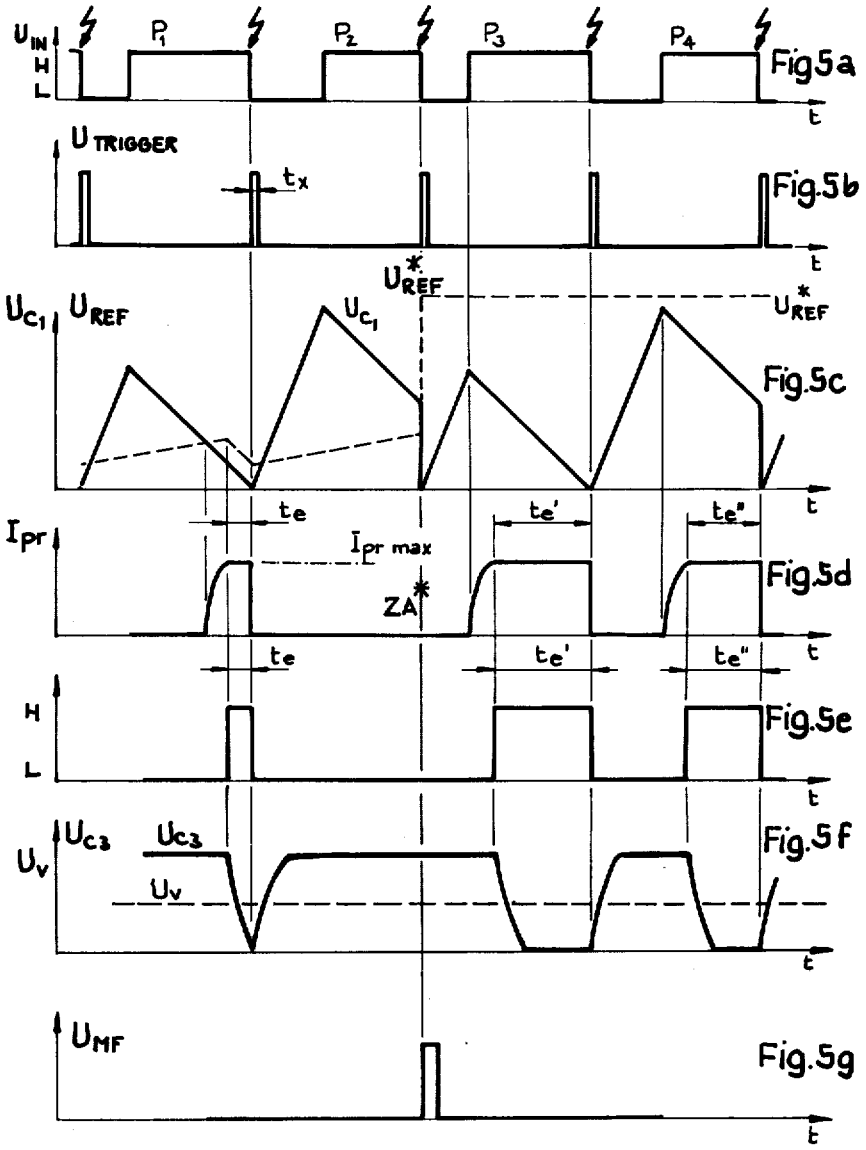
FIGS. 5*a* to 5*g* are voltage-time diagrams showing the mode of operation of the electronic switch off unit when mis-firing occurs.

These error characteristics are eliminated in accordance with the invention by reverting to the current path fixed by the mechanical contact closure time in the primary coil for a fixed time. A general circuit which is suitable for this is shown in FIG. 3 in conjunction with the diagrams of FIGS. 5a to 5g. In FIG. 5a the control signal $U_{IN}$ is shown again when there is periodic mis-firing. The circuit according to FIG. 3 includes a capacitor $C_3$ which is charged with a current $I_{L3}$. The capacitor $C_3$ is discharged via a switch $S_4$ during the time $t_e$ which corresponds to the duration of the primary current at its maximum. The resultant path of the voltage $U_{C3}$ across the capacitor $C_3$ is shown in FIG. 5f. FIG. 5c shows the path of the voltage $U_{C1}$ across the capacitor $C_1$ and the sawtooth path of the reference voltage $U_{REF}$ while the related path of the primary current $I_{pr}$ in FIG. 5d is shown and the $t_e$ pulses are shown in FIG. 5e, said pulses arising from the duration $t_e$ of the primary current at its maximum $I_{prmax}$. The voltage $U_{C3}$ across the capacitor $C_3$ in accordance with FIG. 5f is compared with a comparison voltage $U_V$ by means of a comparator K in accordance with FIG. 3. The fixed voltage $U_V$ is half as great, for example, in accordance with FIG. 5f as the maximum voltage $U_{C3}$ across the charged capacitor $C_3$.

As can be gathered from FIG. 5f, the voltage $U_{C3}$ across capacitor $C_3$ falls during the discharge time $t_e$ to a value which is lower than that of the comparison voltage U and, in the following charge phase, always rises to a value which is above the comparison voltage.

At the end of the second period $P_2$ of the control signal mis-firing ZA occurs for the reasons already mentioned since in accordance with FIG. 5d the current $I_{pr}$ has not flowed in the primary coil at the ignition time. From this it is apparent that at this time there is no pulse present in accordance with FIG. 5e during a time $t_e$ which could discharge the capacitor $C_3$. At the ignition time after the second period $P_2$ of the control signal the voltage $U_{C3}$ across the capacitor $C_3$ is above the value of the comparison voltage $U_V$.

According to FIG. 3 the voltage $U_V$ is compared with the voltage $U_{C3}$ by means of a comparator K. This comparison is preferably implemented so that the comparator K is only activated during a short period of time at the beginning of each period of the control signal.

Therefore a trigger signal $U_{Trigger}$ is supplied to the comparator K in accordance with FIG. 3 and is obtained by differentiation, with the aid of a differentiating element D, from the control signal $U_{IN}$. According to FIG. 5b, only those pulses derived from the negative flanks of the control signal, which introduce ignition, are used as trigger pulses with the duration $t_x$. The comparator K is activated only when trigger pulses are present according to FIG. 5b. At the end of the first period according to FIG. 5f the capacitor voltage $U_{C3}$ is lower than the comparison voltage $U_V$ so that the comparator K does not emit any output signal. At the end of the second period $P_2$, on the other hand, the voltage $U_{C3}$ is above the value $U_V$ because of the altered control signal $U_{IN}$ and the comparator K emits a control signal in accordance with FIG. 5g, said control signal triggering a function which temporarily switches off the electronic control arrangement.

In accordance with FIG. 5c, this function is brought about, for example, in that the reference voltage $U_{REF}$ is raised to a value $U^*_{REF}$ when an output signal $U_{MF}$ appears at the comparator K, said value being in any case higher than the maximum voltage $U_{C1}$ across capacitor $C_1$. As a result, the electronic control arrangement is switched off and the primary current flows in the following periods of the control signal $U_{IN}$ starting the beginning of the high phase.

The duration $t_e'$ or $t_e''$ of the primary current is increased in accordance with FIGS. 5d and 5e in the following periods $P_3$ and $P_4$, so that, the capacitor $C_3$ is discharged during the discharge phases in accordance with FIG. 5f. The time constants of the capacitor $C_3$ for the charging and discharging process are selected so that in accordance with FIG. 5f, the comparison voltage $U_V$ is safely exceeded during each charge process.

Figure 4:
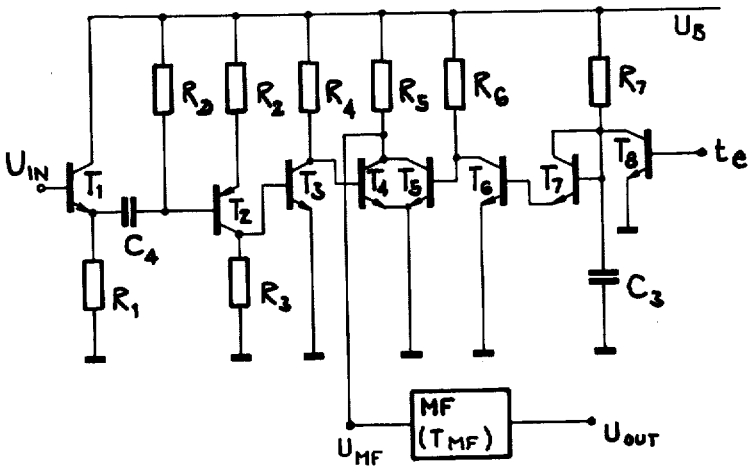
FIG. 4 shows a circuit schematic which forms part of the electronic unit which implements switch off of the control arrangement according to the invention.

FIG. 4 shows a circuit for producing the trigger signal $U_{Trigger}$ in accordance with FIG. 5b and for comparing the voltages $U_{C3}$ and $U_V$ in accordance with FIG. 5f. The control signal $U_{IN}$ is passed via the transistor $T_1$ to the difference element comprising resistor $R_D$ and capacitor $C_4$. At the transistor $T_2$, which is connected thereafter, the trigger pulses emanating from the positive flanks of the control signal $U_{IN}$ are suppressed so that only trigger signals in accordance with FIG. 5b are still present at the collector resistor $R_3$ of transistor $T_2$. These trigger pulses are inverted at transistor $T_3$ so that the transistor $T_4$ of the differential amplifier, comprising transistors $T_4$ and $T_5$, is blocked during each trigger pulse.

Furthermore, capacitor $C_3$ is shown in FIG. 4 and the voltage $U_{C3}$ is present at this capacitor in accordance with FIG. 5f. The capacitor $C_3$ is discharged with the aid of transistor $T_8$, which is made conductive only during the duration $t_e$ of the primary current at its maximum, and charged via $R_7$. Capacitor $C_3$ is connected to the base electrode of transistor $T_5$ of the differential amplifier via a transistor $T_7$ which is connected as a diode and via a transistor $T_6$ which is connected thereafter. Transistors $T_6$ and $T_7$ are only driven when the voltage $U_{C3}$ is greater than 2 $U_{BE} \approx 1.5$ V. Since the capacitor is charged to the voltage $U_B$ when $U_B = 3$ V, $T_6$ and $T_7$ are driven at approximately $U_B$.

If the capacitor voltage $U_{C3}$ is greater than the sum of the base emitter voltages of transistors $T_6$ and $T_7$ then the base current of the transistor $T_5$ which is derived via transistor $T_6$ and transistor $T_7$ becomes blocked. Only when transistor $T_5$ is blocked at a point in time at which the transistor $T_4$ is blocked as a result of an activating pulse having occurred can a jump in voltage occur at the collector of the two transistors $T_4$ and $T_5$. These form the output of the comparator, and therefore an output signal $U_{MF}$ in accordance with FIG. 5g may occur.

This output signal is passed, for example, to a monostable trigger circuit $M_F$ which is converted from its stable condition into its quasi-stable condition. The reference voltage $U_{REF}$ is raised to the value $U^*_{REF}$ in accordance with FIG. 5c by the resultant output signal $U_{OUT}$ at the output of the monostable trigger stage MF in accordance with FIG. 5c, said value being distinctly higher than the peak voltage across capacitor $C_1$.

The duration $T_{MF}$ during which the reference voltage $U_{REF}$ remains at its raised value $U^*_{REF}$, in accordance with FIG. 5c, is fixed by the duration of the monostable trigger MF in the quasi-stable condition. $T_{MF}$ should as already mentioned cover at least several periods of the control signal and in one embodiment is 300 msec-1.5 sec.

The engine will leave the speed range at which there is the risk of mis-firing because the electronic ignition is switched off in accordance with diagrams FIGS. 5a to 5g so that speeds are set at which the extreme fluctuations in speed which are possible in the start-up phase are no longer present.

Figures 6A, 6B, 6C, 6D:
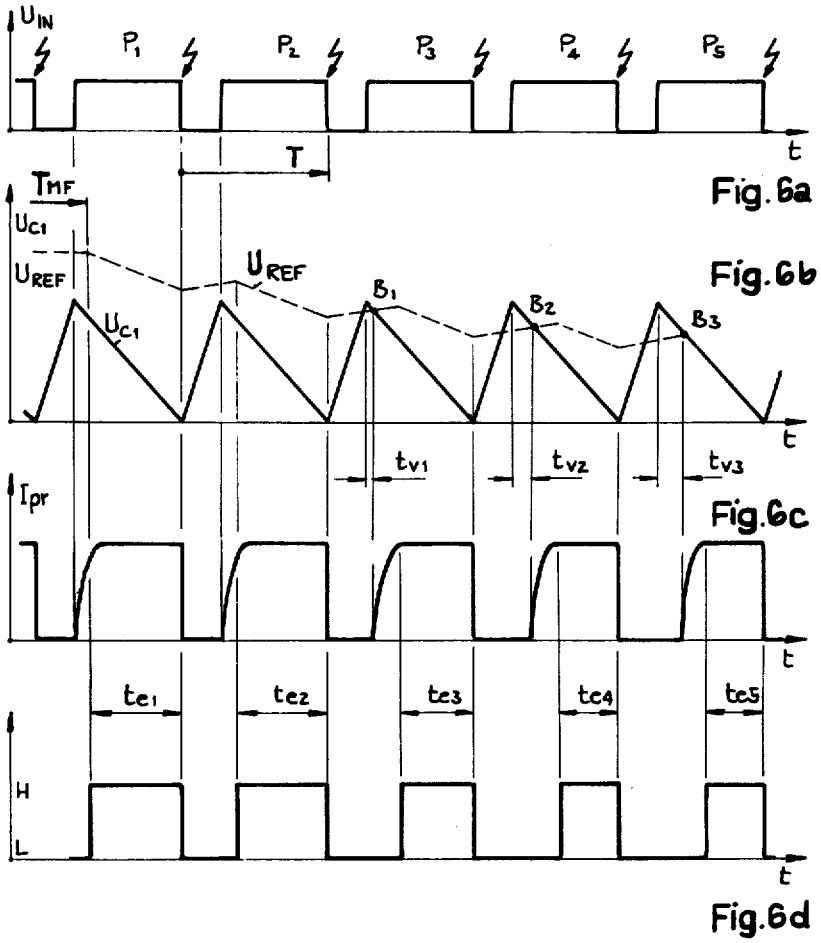
FIGS. 6*a* to 6*d* are voltage-time diagrams showing continuous and automatic reinstitution of the electronically controlled ignition systems after a fixed switch off period has expired in accordance with the invention.

The transition from the mechanical contact closure time to the electronically controlled condition is apparent from FIGS. 6a to 6d and said transition is a sliding transition which occurs once the switch off time $T_{MF}$ expires. FIG. 6a shows the control signal $U_{IN}$ while the contact closure time during the periods $P_1$–$P_5$ is always of the same size. From this it is apparent that the engine has left the critical speed. FIG. 6b shows that the time $T_{MF}$ is terminated during the course of the first period $P_1$. The current $I_{pr}$ through the primary coil flows during the period $P_1$ for the whole of the high phase of the control signal in accordance with FIG. 6c since the reference voltage $U_{REF}$ is above the voltage $U_{C1}$. From the duration of the primary current at its maximum is derived a pulse $t_{e1}$ in accordance with FIG. 6d and once the switch off time $T_{MF}$ has come to an end the reference voltage is built up to the end of the period $P_1$, in accordance with FIG. 6b by the said pulse $P_1$.

During the ignition phase at the beginning of the second period $P_2$, the reference voltage rises again slightly and remains above the value of the voltage $U_{C1}$ across capacitor $C_1$. The primary current then flows in the second period for the whole of the high phase of the control signal $U_{IN}$. During the resultant duration $t_{e2}$ of the primary current at its maximum, the reference voltage is built up to a greater extent during a relatively long period so that, during the period $P_3$, the reference voltage is intersected first of all by the negative flank of the voltage $U_{C1}$ across capacitor $C_1$ at the point $B_1$ in accordance with FIG. 6b. As a result, the point in time at which the primary current is used is postponed by the time $t_{v1}$ in accordance with FIG. 6c. The time $t_{v1}$ arises from the time difference between the point in time at which the voltage $U_{C1}$ reaches its maximum and the intersection point $B_1$.

Nevertheless, in the third period $P_3$ the primary current $I_{pr}$ is at its maximum, in accordance with FIGS. 6c and 6d, for a relatively long time, $t_{e3}$ so that the reference voltage $U_{REF}$ falls further in accordance with FIG. 6b. In the fourth period the time span $t_{v2}$ between the maximum value of the capacitor voltage $U_{C1}$ and the point of intersection $B_2$ is greater than $t_{v1}$ so that the duration $t_{e4}$ of the primary current at its maximum is reduced further.

This stepped reduction in the reference voltage $U_{REF}$ in accordance with FIG. 6b is continued until the controlled condition predetermined by the electronic unit is reinstituted in accordance with FIG. 1c and the duration of the primary current at its maximum is for example 10% of the period T.

The continuously sliding (i.e. gradual) transition into the electronically controlled condition ensures that there is no excessive oscillation of the control system and avoids mis-firing safely when there are periodic fluctuations in speed.

It will be understood that the above description of the present invention is susceptible to various modifications, changes and adaptations.

What is claimed is:

1. An electronically controlled ignition system for an internal combustion engine having a spark plug which is ignited by an ignition voltage pulse of a given magnitude comprising:

an ignition coil having primary and secondary windings, said secondary winding being connected for supplying the ignition voltage pulse to the spark plug in response to a primary current in said primary winding;

an ignition pulse generator for producing a control signal corresponding to the speed of the engine;

an electronic control means connected to said ignition pulse generator and to said ignition coil and being responsive to the control signal for controlling the time period during which current flows in said primary winding in dependence of the speed of the engine, said electronic control means producing an output signal which is used to control the time at which primary current starts to flow in said primary winding so that the primary current reaches a magnitude corresponding to the given magnitude of the ignition voltage pulse just prior to when the spark plug is ignited, said electronic control means further providing a determination of when there is insufficient current in said primary winding to prevent a mis-fire of the spark plug during a fluctuation in engine speed and upon such a determination substituting, for a fixed period, the control signal of said pulse generator for the output signal of said electronic control means so that the time at which primary current starts to flow in said primary winding is determined directly by the control signal, said electronic control means further automatically and continuously reinstituting the use of the output signal of said electronic control means to control the time at which primary current starts to flow in said primary winding at the end of the fixed period.

2. The system as defined in claim 1, wherein the control signal is periodic and the fixed period lasts for at least two periods of the control signal.

3. The system as defined in claim 2, wherein the fixed period is from 300 msec to approximately 1.5 sec.

4. The system as defined in claim 1, wherein said electronic control means includes:

pulse means for deriving a test pulse corresponding to the duration of the current in said primary winding at or above the magnitude which corresponds to the given magnitude of the ignition voltage pulse;

a current supply, a capacitor connected to said current supply for charging a voltage across said capacitor, said pulse means connected to said capacitor for varying the voltage across said capacitor in response to the test pulse;

voltage means for generating a constant magnitude comparison voltage;

comparison means connected to said capacitor and to said voltage means for producing an output signal corresponding to a comparison of the voltage across said capacitor with the constant comparison voltage, the output signal being indicative of an insufficient current in said primary winding; and switching means responsive to the output signal of said comparison means for substituting the control signal for the output signal of said electronic control means to control the time at which the current starts to flow in said primary winding.

5. The system as defined in claim 4, wherein said capacitor is charged and discharged under the control of only the test pulse.

6. The system as defined in claim 4, wherein the test pulse has a pulse duration corresponding to the duration of the current in said primary winding at a magnitude at or above the magnitude corresponding to the given magnitude of the ignition voltage pulse.

7. The system as defined in claim 4, wherein the presence of the test pulse causes said capacitor to undergo a voltage discharging process and the absence of the test pulse causes said capacitor to undergo a voltage charging process, and said capacitor has a discharging voltage time constant such that the voltage across said capacitor always falls below the magnitude of the said constant comparison voltage during a discharge process and said capacitor has a charging voltage time constant such that the voltage across said capacitor always rises above the magnitude of the constant comparison voltage during a following charging process, and further wherein the ignition of the spark plug is followed by an ignition phase and the control signal indicates the time of ignition and the following ignition phase, and said comparator means is activated briefly at the beginning of the ignition phase as indicated by the control signal for the comparison of the voltage across said capacitor with the constant comparison voltage.

8. The system as defined in claim 7, wherein said comparison means produces an output signal only when the voltage across said capacitor is above the constant comparison voltage when said comparison means is activated.

9. The system as defined in claim 7, wherein the control signal has a pulse with an edge which signifies the beginning of the ignition phase and said electronic control means includes activating means connected to said comparator means, said activating means being connected for receiving the control signal, producing an activating pulse in response to the edge of the pulse of the control signal and feeding the activating pulse to said comparator means.

10. The system as defined in claim 9, wherein the pulse of said control signal has a leading edge and a trailing edge and said activating means differentiates the control signal to produce activating pulses corresponding to the leading and trailing edges and said activating means subsequently suppresses the activating pulse corresponding to the leading edge.

11. The system as defined in claim 7, wherein said switching means includes a monostable trigger circuit having a stable condition and a quasi-stable condition and the output signal of said comparison means causes said monostable trigger circuit to change over from the stable condition to the quasi-stable condition for a predetermined period, said monostable trigger circuit being connected to cause the time at which current starts to flow in said primary winding during the quasi-stable condition to be derived directly from the control signal of said pulse generator.

12. The system as defined in claim 11, wherein the control signal has a first state corresponding to the ignition phase and a second state which alternates with the first state and said electronic control means includes a reference means for generating a reference voltage and capacitor means for generating a sawtooth signal from the control signal, the voltage magnitude of the sawtooth signal defining a sawtooth curve having positive and negative flanks, said capacitor means being charged during the first state of the control signal to produce a positive flank of the sawtooth curve and discharged during the second state of the control signal to produce a negative flank of the sawtooth curve; and wherein the point in time at which current starts to flow in said primary winding corresponds to when the magnitude of the negative flank of the sawtooth curve equals the magnitude of the reference voltage.

13. The system as defined in claim 12, wherein said reference means is responsive to the quasi-stable state of said monostable trigger circuit for increasing the magnitude of the reference voltage above the highest magnitude of the sawtooth signal for a period fixed by the predetermined period of such quasi-stable condition.

14. The system as defined in claim 13, wherein the period during which the current in the primary winding maintains a magnitude at or above the magnitude corresponding to the given magnitude of the ignition voltage pulse constitutes a dwell period and the dwell period is increased during the fixed period, said reference means produces a sawtooth reference voltage having a magnitude which defines a periodic sawtooth shaped curve, with the magnitude of the sawtooth reference voltage rising until the magnitude of current in the primary winding just reaches the magnitude corresponding to the given magnitude of the ignition voltage pulse and dropping during the dwell period, and wherein electronic control of the point in time at which current starts to flow in said primary winding is reinstituted at the termination of the quasi-stable condition of said monostable trigger circuit in stages over several periods of the control signal as a result of the magnitude of the sawtooth reference voltage being reduced in stages from its magnitude above the highest magnitude of the sawtooth signal of said capacitor means to a magnitude required for the electronic control by said electronic control means, the reduction in magnitude of the sawtooth reference signal being effected by the increased dwell period which is simultaneously reduced.

* * * * *